US006709096B1

(12) United States Patent
Beach et al.

(10) Patent No.: US 6,709,096 B1
(45) Date of Patent: Mar. 23, 2004

(54) METHOD OF PRINTING AND LAYERED INTERMEDIATE USED IN INKJET PRINTING

(75) Inventors: Bradley Leonard Beach, Lexington, KY (US); Ligia Aura Bejat, Versailles, KY (US); Gerald Lee Fish, Versailles, KY (US); Philip Jerome Heink, Lexington, KY (US); David Starling MacMillan, Winchester, KY (US); Jean Marie Massie, Lexington, KY (US); Peter Brown Pickett, Lexington, KY (US); Ronald Lloyd Roe, Lexington, KY (US); Sean David Smith, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/295,329

(22) Filed: Nov. 15, 2002

(51) Int. Cl.[7] ..... B41J 2/01; B41J 2/17

(52) U.S. Cl. ..... 347/103; 347/96

(58) Field of Search ..... 347/96, 103

(56) References Cited

U.S. PATENT DOCUMENTS

| | | | |
|---|---|---|---|
| 2,753,276 | A | 7/1956 | Brochhagen et al. |
| 3,892,645 | A | 7/1975 | Castegnier |
| 4,521,785 | A | 6/1985 | Matsufuji |
| 4,595,931 | A | 6/1986 | Toganoh et al. |
| 4,636,409 | A | 1/1987 | Arai et al. |
| 4,643,917 | A | 2/1987 | Koshizuka et al. |
| 4,664,952 | A | 5/1987 | Arai et al. |
| 4,725,849 | A | 2/1988 | Koike et al. |
| 4,868,581 | A | 9/1989 | Mouri et al. |
| 4,880,324 | A | 11/1989 | Sato et al. |
| 4,903,041 | A | 2/1990 | Light |
| 4,914,079 | A | 4/1990 | Takei et al. |
| 4,966,464 | A | 10/1990 | Matoushek |
| 5,099,256 | A | 3/1992 | Anderson |
| 5,168,289 | A | 12/1992 | Katakabe et al. |
| 5,364,461 | A | 11/1994 | Beach et al. |
| 5,365,261 | A | 11/1994 | Ozawa et al. |
| 5,372,852 | A | 12/1994 | Titterington et al. |
| 5,502,476 | A | 3/1996 | Neal et al. |
| 5,512,930 | A | 4/1996 | Brandt et al. |
| 5,534,905 | A | 7/1996 | Takahashi et al. |
| 5,538,601 | A | 7/1996 | Castegnier |
| 5,541,636 | A | 7/1996 | Ingram |
| 5,610,635 | A | 3/1997 | Murray et al. |
| 5,623,296 | A | 4/1997 | Fujino et al. |
| 5,640,180 | A | 6/1997 | Hale et al. |
| 5,662,734 | A | 9/1997 | Crystal |
| 5,694,160 | A | 12/1997 | Taguchi et al. |
| 5,698,018 | A | 12/1997 | Bishop et al. |
| 5,710,070 | A | 1/1998 | Chan |
| 5,714,538 | A | 2/1998 | Beach et al. |
| 5,719,204 | A | 2/1998 | Beach et al. |
| 5,742,307 | A | 4/1998 | Watrobski et al. |
| 5,746,816 | A | 5/1998 | Xu |
| 5,750,592 | A | 5/1998 | Shinozuka et al. |
| 5,764,261 | A | 6/1998 | Koike et al. |
| 5,805,191 | A | 9/1998 | Jones et al. |
| 5,808,645 | A | 9/1998 | Reeves et al. |
| 5,837,754 | A | 11/1998 | Shimomura et al. |
| 5,841,456 | A | 11/1998 | Takei et al. |

(List continued on next page.)

*Primary Examiner*—Michael S Brooke
(74) *Attorney, Agent, or Firm*—John A. Brady

(57) ABSTRACT

A layered intermediate used in inkjet printing contains a release coat formed on a transfer medium in an area where an image has not been printed. The release coat is formed of polyvinyl pyrrolidone (PVP) or a PVP copolymer and at least one solvent selected from the group consisting of glycol solvents and diol solvents. A viscous coating of PVP or the PVP copolymer is formed on the transfer medium in an area where an image has been printed. A release layer formed from components in the release coat and components in the ink is formed on the viscous coating. A first ink layer is formed on the release layer of flocculated ink. A second ink layer is formed on the first ink layer, of ink that is substantially not flocculated.

5 Claims, 6 Drawing Sheets

U.S. PATENT DOCUMENTS 5,847,026 A 12/1998 Kitahara et al.
5,858,075 A 1/1999 Deardurff et al.
5,886,727 A 3/1999 Dobashi et al.
5,908,541 A 6/1999 Castegnier
5,985,975 A 11/1999 Kurabayashi et al.
6,059,407 A 5/2000 Komatsu et al.
6,123,419 A 9/2000 Cleland
6,196,674 B1 3/2001 Takemoto
6,357,870 B1 3/2002 Beach et al.
6,398,357 B1 6/2002 Holloway et al.

t = 0 ms t = 150 ms t = 300ms t = 5 s t = 10 s t = 60 s

METHOD OF PRINTING AND LAYERED INTERMEDIATE USED IN INKJET PRINTING

BACKGROUND OF THE INVENTION

1. Field of the Invention

The present invention relates generally to inkjet printing. More specifically, the present invention relates to inkjet printing onto an intermediate transfer medium coated with a liquid coating solution.

2. Description of the Related Art

Early inkjet printers had several distinct advantages over laser printers. They could print in color and had size and cost advantages. However, in order for the next generation of inkjet printers to compete with laser printers in an office environment, it will be necessary to increase the printing speed and print quality. As a goal, a printing speed of 20 pages per minute is desired. For print quality, a black print density of 1.4 as measured on an optical densitometer and a resolution of at least 600 dots per inch are desired.

To achieve these goals and successfully compete with laser printers in the business printer market, it has been proposed to print from an inkjet head onto an intermediate transfer surface (e.g. a drum) and then transfer the image onto a final medium (e.g. paper). Prior attempts at this intermediate transfer type printing have resulted in poor transfer efficiency, that is, the image printed onto the intermediate transfer surface did not substantially completely transfer to the final medium. Some of the material deposited on the intermediate transfer surface remained after transfer. Prior attempts at using an intermediate transfer medium with inkjet printing have also resulted in poor optical density.

SUMMARY OF THE INVENTION

Accordingly, it is an object of the present invention to increase the speed of inkjet printing.

It is a further object of the present invention to increase the optical density of images printed by inkjet printing.

It is a still further object of the present invention to enable inkjet printing using an intermediate transfer medium in which the transfer efficiency to the final medium is increased.

These and other objects are accomplished by a layered intermediate used in inkjet printing. The layered intermediate contains a release coat formed on a transfer medium in an area where an image has not been printed. The release coat is formed of a water soluble polymer or a water soluble copolymer and at least one hydroxyl containing solvent. Polyvinyl pyrrolidone (PVP) and polyvinyl pyrrolidone copolymer may serve as the water soluble polymer and water soluble copolymer, respectively. Glycol solvents or diol solvents may be used as the hydroxyl containing solvent. A viscous coating formed of PVP or PVP copolymer, for example, from the release coat is formed on the transfer medium in an area where an image has been printed. A release layer formed from components in a coating solution and components in an ink is formed on the viscous coating.

A first ink layer of flocculated ink is formed on the release layer. A second ink layer is formed on the first ink layer, of ink that is substantially not flocculated. The first and second ink layers contain about 0.01 to about 15 wt. % of a wetting agent selected from the group consisting of 1,2 alkyldiols having 4–10 carbon atoms and diether alcohols having 6–14 carbon atoms.

BRIEF DESCRIPTION OF THE DRAWINGS

The invention will be readily understood by reference to the following description of preferred embodiments described by way of example only, with reference to the accompanying drawing, wherein.

DETAILED DESCRIPTION OF THE PREFERRED EMBODIMENTS

Figure 1:
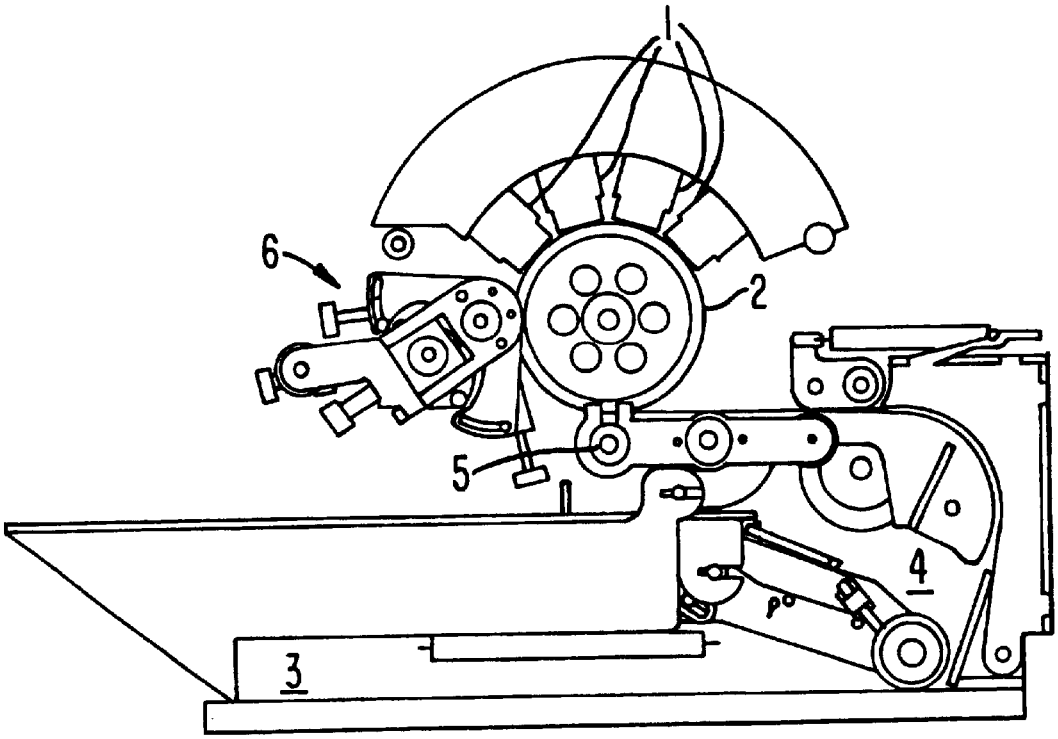
FIG. 1 is the side view of an inkjet printer according to one embodiment of the present invention.

FIG. 1 is a side view of an inkjet printer according to a preferred embodiment of the present invention. One or more inkjet printheads 1 are mounted over an intermediate transfer medium 2 (shown in FIG. 1 as a drum), at a distance of 1 mm or less from the drum. FIG. 1 shows four printheads 1, but the invention is not so restricted. A conventional inkjet printhead can be used with the printer. The ink supplied to the printheads 1 has a relatively high amount of wetting agent.

As the inkjet printheads 1 move along the axis of the drum 2, they are printing. At the same time, drum 2 is rotating. A heater may be provided within the core of the drum 2 to heat the drum 2. The drum 2 may be made of a metal such as stainless steel or aluminum. Alternatively, the drum may have rigid core, formed of stainless steel, aluminum or other material, covered with a rubber.

The final medium (e.g. paper) is kept within cavity 3. The paper is supplied to the drum 2 from the cavity 3 with a paper feed mechanism 4. From the paper feed mechanism 4, paper is fed through a nip to bring the paper into contact with the drum 2. Specifically, a transfer roller 5 is used to bring the paper into contact with the drum 2. Roller 5 may be solid or formed of a foam urethane, silicone or other type of rubber. Great pressure is not necessary between the roller 5 and the drum 2. A pressure of 25 psi or less is sufficient.

The drum 2 may be covered with a rubber material. Polyurethane is a preferred rubber material. A liquid cast polyurethane may be used. The prepolymer of the polyurethane polymer may be cured with a polyether or a polyester type polyol or an amine based curative. Any type of rubber may be used to cover the drum, as long as the surface energy of the rubber is similar to the surface energies of a liquid drum coating solution (described below) and the ink to allow for good wetting of the rubber.

Both the ink and the liquid coating solution must sufficiently wet the drum. The liquid coating solution is applied to the drum 2 during the print process by a roll coating or other mechanism 6. The drum 2 rotates in a clockwise direction. Therefore, the coating solution from the roll coating mechanism 6 is applied to the drum 2 before the drum 2 reaches the printheads 1. The liquid coating solution forms a sacrificial layer on the drum, which sacrificial layer is transferred along with the image to the paper. By forming a film on the drum, the liquid coating solution increases the transfer efficiency to the paper so that preferably substantially all of the ink is transferred from the drum to the paper.

The coating solution further prevents colored inks from bleeding into each other. With these properties, the coating solution increases optical density and improves image resolution. The coating solution should completely coat (wet) the drum. For this purpose, the coating solution and the drum should have similar surface energies. Usually, the surface energy of the drum is somewhat higher than the surface energy of the coating solution. The surface energy of the solid drum is determined based on the Young Dupré relation using the Kaelble equation of state (J. Adhesion, Vol. 2, page 66 (1970)). The surface energy of the liquid coating solution is determined using the DuNuoy Ring method.

A mixture containing a water soluble polymer, polyvinyl pyrrolidone (PVP) for example, works very well for the liquid coating solution. In the coating solution, PVP may be contained in an amount of 0.01 to 20 wt. %. More particularly, PVP may be contained in an amount of 0.01 to 15 wt. %, and still more particularly, PVP may be contained in an amount of 2–8 wt. %. Although the molecular weight can be varied, higher molecular weights are associated with better transfer efficiency. If the molecular weight is extremely high, however, the coating solution becomes very viscous and difficult to apply to the drum. The molecular weight should be over 400,000. More particularly, the molecular weight should be over 750,000. Still more particularly, the molecular weight should be within the range of 850,000 to 1,150,000.

Instead of a water soluble polymer, a water soluble copolymer, such as a PVP copolymer, can be used. A list of suitable PVP copolymers includes copolymers with vinyl acetate, dimethyl aminopropyl methacrylamide, dimethyl amino ethyl methacrylate, quaternized dimethyl amino ethyl methacrylate, and methacryl amido propyl trimethyl ammonium chloride.

Aside from PVP, the liquid coating solution may also contain an organic solvent and water. The liquid coating solution may contain 5–95 wt. % organic solvent and preferably 50–95 wt. % organic solvent. In general, hydroxyl solvents can be used for the organic solvent. Diols, glycols and other organic solvents work well as the organic solvent. Suitable solvents include propylene glycol, 1,2 butane diol, glycerol, trimethylene glycol, diethylene glycol, di propylene glycol, tripropylene glycol, gamma-butyrolactone and 2 pyrrolidone.

The water used for the liquid coating solution is preferably deionized water. The coating solution may contain 5–90 wt. % water and more particularly 5–50 wt. % water.

The liquid coating solution may also contain a flocculating agent, a reagent added to a dispersion of solids in a liquid to bring together fine particles to form "flocs." These flocs are small masses formed in the liquid through coagulation or agglomeration of fine suspended particles. The ink is supplied as a dispersion of solid pigment particles. The flocculating agent or "flocculant" counteracts the effect of the ink dispersant. The flocculant therefore causes the pigment to come out of solution and clump together. Once the ink is on the drum or the paper, the flocculant stabilizes the pigment particles to prevent the pigment particles from moving. The flocculant fixes the particles to ensure good print quality.

As mentioned previously, a heater may be provided within the core of the drum 2 to heat the drum 2. When the drum 2 is heated, the liquid within the ink is evaporated, thereby fixing the pigment onto the drum. By forcing the pigment particles out of solution, the flocculant achieves the same goal as the heater. Thus, if the liquid coating solution contains a flocculating agent, it is not necessary to provide a heater within the core of the drum 2.

If a flocculant is to be used, the liquid coating solution may contain 0.1 wt. % to 10 wt. % of the flocculant. More particularly, the liquid coating solution may contain 0.5 wt. % to 5 wt. % of the flocculant. Suitable flocculating agents include acids and salts. Suitable acids include carboxylic acids such as citric, glycolic, tartaric, 1,2,3,4-butane tetracarboxylic, glutaric, succinic, lactic, and adipic acids. Suitable salts include $CaCl_2$, $AlCl_3$, and magnesium salicylate tetrahydrate.

In addition to the foregoing components, it is advantageous for the liquid coating solution to contain substantially no fluorocarbon surfactants. These additives reduce the surface energy of the coating too much and give poor wetting of the drum. The drum coating solution is applied to the drum in an amount of 0.01 to 10 mg/cm2 and more particularly in an amount of 0.01 to 3 mg/cm2. The drum coating solution can be applied with a wick, felt pad, 3 roll coating system, foam roller or other method. Again, the drum coating solution should wet substantially the entire printing surface of the drum. The coating solution can range in thickness from 0.5 $\mu$m to greater than 6.0 $\mu$m in thickness on the intermediate transfer medium. Preferably the thickness will be less than 2 $\mu$m.

The diameter of an inkjet drop is influenced by a variety of factors including nozzle diameter, ink properties, and firing characteristics. Current inkjet printers generate drops with diameters that range from 10 $\mu$m to over 40 $\mu$m. The ratio of ink volume to coating solution volume is therefore at least 5 to 1 for a complete image coverage, wherein complete image coverage implies that there is coating solution beneath the image in all locations. In other words, wherever there is a drop of ink there is coating solution.

As mentioned previously, the ink used for inkjet printing should contain a relatively high amount of wetting agent. Specifically, the ink should contain 0.1 to 15 wt. % wetting agent. More particularly, the ink should contain 1–5 wt. % wetting agent. Still more particularly, the ink should contain 2.5–3.5 wt. % wetting agent. The purpose of the wetting agent is to ensure that a good image is formed. Diols and diethers may be used as the wetting agent. For diols, 1,2 alkyl diols having 4–10 carbon atoms are appropriate. 1,2 hexanediol has been found to work particularly well. For diethers, diether alcohols having 6–14 carbon atoms are appropriate. Hexylcarbitol has been found to work particularly well. Comparing diols and diethers, if a diether is used, less wetting agent may be required. For example, 0.01 to 2.5 wt. % diether could produce the same good results as 1.0 to 5.0 wt. % diol.

The ink used with the present invention employs organic or inorganic pigments as the colorants. The term "pigment" as used herein refers to an insoluble colorant formed of small pigment particles. The present invention is not restricted to the type of pigment. Pigments such as azo pigments, polycyclic pigments, perylene pigments, anthraquinone pigments, quinacridone pigments, dioxazine pigments, thioindigo pigments, isoindolinone pigments, quinophthalone pigments, nitro pigments, nitroso pigments, aniline black and daylight fluorescent pigments can be used with the invention. Titanium oxide, iron oxide and carbon black are specific pigments known to work well.

Because the pigment is insoluble, it is generally stabilized in a dispersion. The pigment/dispersion mixture is used as a pigment concentrate (also referred to as a "pigment premix") in forming the ink. U.S. Pat. Nos. 5,714,538 and 5,719,204 describe a terpolymer pigment dispersant suitable for use with the present invention. Both of these references are incorporated herein by reference. The pigment/dispersion concentrate (pigment premix) may contain from about 0.5 to about 10% by wt. pigment and 0.25% to 10% by wt. terpolymer dispersant in an aqueous carrier.

In addition to the pigment premix and the wetting agent, the ink also contains a binder, one or more humectants, a biocide and water. The ink may or may not contain other ingredients such as chelating agents, buffers, surfactants, surface tension modifier, etc. The humectants may be used to absorb or retain moisture. Glycerol, propylene glycol, polyethylene glycol and thiodiethanol are possible humectants. For the biocide, Proxel® GXL, commercially available from Zeneca, Inc. (now "Avecia, Inc."), may be used. Proxel® GXL contains 1,2 benzisothiazolin-3-one as the active ingredient and also contains dipropylene glycol and water.

As to the relative amount of each component, the ink may contain about 1 to about 7 wt. % pigment (from the pigment premix), wetting agent in the amount described above, about 1 to about 50 wt. % humectant(s), with the balance being deionized water.

The first function of the coating solution is to prevent the ink from penetrating to the intermediate transfer medium. This is accomplished with an agent (perhaps PVP) that increases the viscosity of the coating solution sufficiently to reduce the momentum of the jetted drop of ink. Higher viscosity materials also permit thinner coatings on the intermediate transfer medium. If the coating solution does not prevent penetration of the drop or is non-uniform, thus leaving exposed intermediate transfer medium areas, the ink will come in contact and wet the intermediate transfer medium directly. The resulting incomplete ink transfer leaves significant residual ink colorant on the intermediate transfer medium and causes poor image formation on the media.

The second function of the coating solution is to maintain drop location to assure proper image formation. This is accomplished by matching the surface tension of the coating solution with that of the ink. If the surface tension of the coating solution is significantly higher than that of the ink, the image will spread. If the surface tension is significantly lower than that of the ink, the image will shrink and coalesce. Neither condition gives acceptable print quality. Destabilization of the colorant will also help maintain drop location by reducing spread due to bleed and diffusion. The surface energies of the ink and the coating solution should differ by no more than 10 dynes/cm. Preferably, the surface energy of the ink should be 2–9 dynes/cm less than the surface energy of coating solution.

The third function of the coating solution is to create a release interface between the intermediate transfer medium and the ink. This is accomplished by destabilizing the colorant dispersion in the ink. This release material has demonstrated effective destabilization of the pigment using diffusion and evaporation (chemical flocculation (with the flocculant)). As the ink is destabilized, it retreats from the coating solution, moving towards the top of the ink drop where the ink is relatively more stable. The movement and destabilization is aided by the rapid diffusion of the organic solvent (perhaps propylene glycol) from the coating solution to the ink and diffusion of water, for example, from the ink to the coating solution. Because the PVP is much higher in molecular weight than the other ink and coating solution components, the diffusion rate of PVP into the ink is very slow. After diffusion and destabilization, there is a release layer between the viscous coating solution component(s), such as PVP, and a dense flocculated ink region. The release layer is a mixture of components from the coating solution and components from the ink, but contains substantially no colorant. For example, the release layer may contain citric acid, water and polyethylene glycol. Depending on the quantity of ink printed and destabilization agent in the coating solution, there may also be a layer of ink above the destabilized colorant layer that is unaltered ink.

Figure 2:
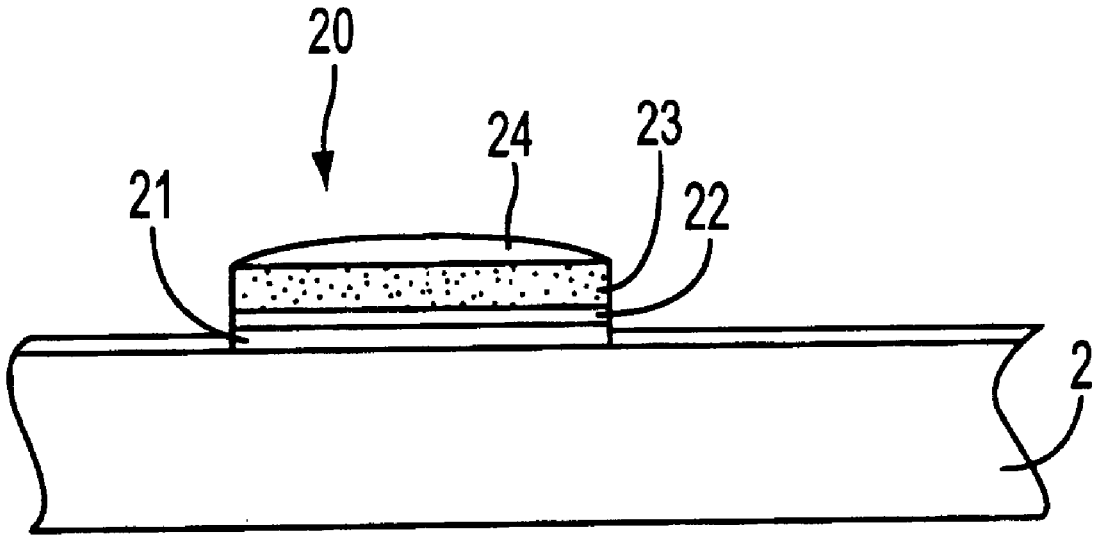
FIG. 2 is a cross-sectional view of printing layers formed on a substrate according to one embodiment of the present invention.

FIG. 2 is a cross-sectional view of printing layers formed on a substrate according to an embodiment of the present invention. The intermediate transfer medium 2, a drum, for example, may serve as the substrate 2. Hereafter, the three terms "intermediate transfer medium," "substrate" and "drum" are used interchangeably. A release coat 11 is formed on the intermediate transfer medium 2 by the roll coating mechanism 6. The release coat 11 may be formed on the entire surface of the intermediate transfer medium 2 using the coating solution. When the inkjet print heads 1 print ink onto the drum 2, a layered ink deposit 20 is formed. Components in the ink interact with components in the coating solution, as described above. The interaction creates the layered ink deposit 20. A viscous coating 21 is formed on the drum 2, perhaps directly on the drum 2. The viscous coating 21 is formed primarily from the PVP in the coating solution. The release layer described above, which is formed from components in the coating solution and components in the ink, is represented by reference numeral 22. The release layer 22 may contain no colorant.

A first ink layer 23 of flocculated ink is formed on the release layer 22. The flocculated ink in the first ink layer 23 is formed of clumps of pigment particles. These clumps may be caused by destabilization of the ink from diffusion of the flocculating agent. A second ink layer 24 may be formed on the first ink layer 23. The second ink layer 24 may not have clumps of pigment particles. The second ink layer 24 is formed from the pigment colorant retreating away from the coating solution.

Note that the layers in FIG. 2 may not have distinct boundaries, but rather may have gradients in chemistry throughout the mixture. The layered diagram above provides an easy way of describing the layered ink deposit 20 prior to transfer.

During transfer, the second ink layer 24 will serve to absorb or fill into the surface of the desired media, effectively 'linking' the image to the media. The first ink layer 23 is paste like in consistency and more cohesive than the release layer 22 beneath it, which consists primarily of ink constituents and low molecular weight materials from the coating solution. Beneath these two layers is the viscous coating 21 formed from the higher viscosity solution of PVP and remaining coating solution constituents. During transfer to the media, the layered ink deposit 20 will split within the layer with the least cohesive strength. The least cohesive layer is the release layer 22 generated between the first ink layer 23 and the viscous coating 21. Therefore, film splitting occurs in this layer providing substantially complete transfer of the colorant to the media. Transfer is substantially better than a 50% transfer a film split model would predict. For example, at least a 75% transfer of the colorant media is achieved, more particularly, at least a 90% transfer is achieved.

EXAMPLES

Example One

The surface of a rotating drum was formed of Adiprene L42™ (Uniroyal Chemical) cured with polyether polyol Simusol TOIE™ (Seppic). The drum was heated to a temperature of 30° C. and rotated at a speed of 15.1 in/sec. While rotating, a drum coating solution including 5 wt. % PVP K90™ (ISP), 60 wt. % propylene glycol, and 35 wt. % deionized water was applied to the drum. After coating, a black pigmented ink containing 3 wt. % hexanediol was applied to the rotating drum using an inkjet printhead. The image was transferred from the drum to paper. A silicone foam roller with a hardness of 45 Asker C (500 g) was used as the transfer roll. The system described above produced a black image having an optical density of 1.4. The resolution of the image was 600 dots per inch. 20 pages per minute are envisioned by the system.

Example Two

The surface of a rotating drum was formed of Adiprene L42™ (Uniroyal Chemical) cured with polyether plyol Simusol TOIE™ (Seppic). The drum was heated to a temperature of 30° C. and rotated at a speed of 15.1 in/sec. While rotating, a drum coating solution including 5 wt. % PVP K120™ (ISP), 50 wt. % tripropylene glycol and 45 wt. % deionized water was applied to the drum. After coating, a pigmented black ink containing 4 wt. % hexanediol was applied to the rotating drum using an inkjet printhead. The image was transferred from the drum to paper. An aluminum transfer roll was used as the transfer roll. The system described above produced a black image having an optical density of 1.4. The resolution of the image was 600 dots per inch. A substantially complete transfer of the ink was achieved.

Example Three

The surface of a rotating drum was formed of Adiprene L42™ (Uniroyal Chemical) cured with polyether plyol Simusol TOIE™ (Seppic). The drum was heated to a temperature of 50° C. and rotated at a speed of 15.1 in/sec. While rotating, a drum coating solution including 5 wt. % PVP K120™ (ISP), 75 wt. % 1,2 propane diol and 20 wt. % deionized water was applied to the drum. After coating, a pigmented black ink containing 4 wt. % hexanediol was applied to the rotating drum using an inkjet printhead. The image was transferred from the drum to paper. An aluminum transfer roll was used as the transfer roll. The system described above produced a black image having an optical density of 1.4. The resolution of the image was 600 dots per inch. A substantially complete transfer of the ink was achieved.

Example Four

The surface of a rotating drum was formed of Adiprene L42™ (Uniroyal Chemical) cured with polyether plyol Simusol TOIE™ (Seppic). The drum was heated to a temperature of 50° C. and rotated at a speed of 15.1 in/sec. While rotating, a drum coating solution including 5 wt. % PVP copolymer, Copolymer 845™ (ISP) (supplied as 20 wt. % of the copolymer in water), 50 wt. % tripropylene glycol and 45 wt. % deionized water was applied to the drum. After coating, a pigmented black ink containing 4 wt. % hexanediol was applied to the rotating drum using an inkjet printhead. The image was transferred from the drum to paper. An aluminum transfer roll was used as the roll. The system described above produced a black image having an optical density of 1.4. The resolution of the image was 600 dots per inch. A substantially complete transfer of the ink was achieved.

Example Five

The surface of a rotating drum was formed of Adiprene L42™ (Uniroyal Chemical) cured with polyether plyol Simusol TOIE™ (Seppic). The drum was heated to a temperature of 50° C. and rotated at a speed of 15.1 in/sec. While rotating, a drum coating solution containing 3 wt. % PVP K90™ (ISP), 77 wt. % 1,2 propane diol and 20 wt. % deionized water was applied to the drum. After coating, a pigmented black ink containing 3 wt. % hexanediol was applied to the rotating drum using an inkjet printhead. The image was transferred from the drum to paper. An aluminum transfer roll was used as the transfer roll. The system described above produced a black image having an optical density of 1.4. The resolution of the image was 600 dots per inch. A substantially complete transfer of the ink was achieved.

Example Six

The surface of a rotating drum was formed of a Adiprene L42™ (Uniroyal Chemical) cured with polyether polyol Simusol TOIE™ (Seppic). The drum was not heated. The drum was rotated at a speed of 15.1 in/sec. While rotating, a drum coating solution including 5 wt. % PVP K90™ (ISP), 5 wt. % citric acid flocculating agent, 40 wt. % tripropylene glycol, 30 wt. % propylene glycol and 20 wt. % deionized water, was applied to the drum. After coating, a black, cyan, yellow or magenta pigmented black ink containing 3 wt. % hexanediol was applied to the rotating drum using an inkjet printhead. The image was transferred from the drum to paper. A PFA sleeved silicone foam was used as a transfer roller. The system described above did not require for the drum to be heated and produced an image having good optical density and resolution.

Example Seven

It is known that a liquid film present on one roller surface will split 50/50 between two rollers in rolling contact that have matching surface characteristics and surface velocities. In an intermediate transfer medium transfer system, the media substitutes for the second roller. The media travels at the same surface velocity as the intermediate transfer medium (serving as the first roller). It has been documented that where the coating solution is present on the intermediate transfer medium without an overlaying ink layer, the coating solution will split approximately 50/50 between the intermediate transfer medium and the final media (paper). This conforms to the known model. With regard to areas where there is both the coating solution and an overlaying ink layer, there is at least five times the volume of ink as coating solution on the intermediate transfer medium. Therefore, one might expect that a standard 50/50 film split would leave a significant quantity of colorant remaining on the intermediate transfer medium.

Figure 3:
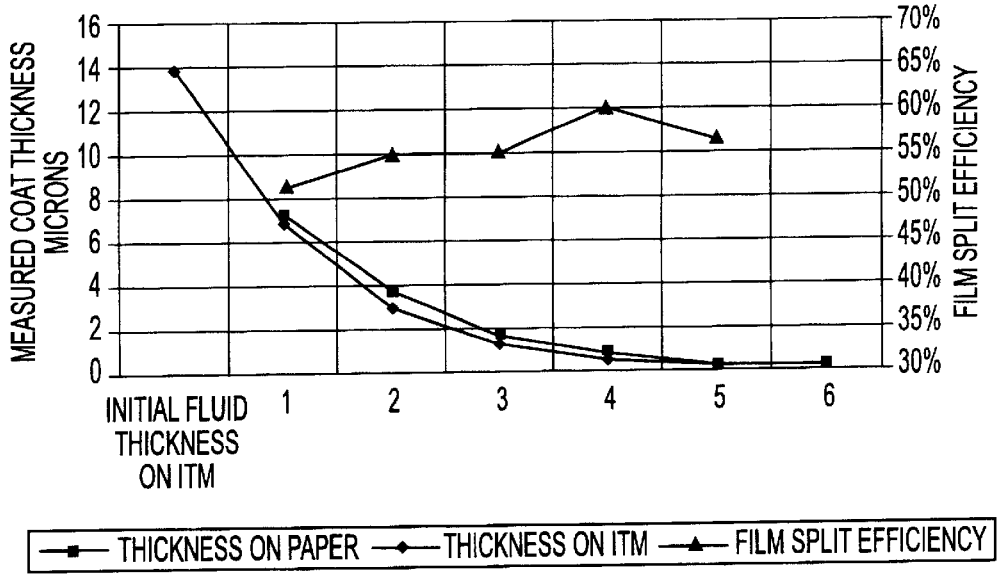
FIG. 3 is a chart showing film split efficiency.
Figure 4A:
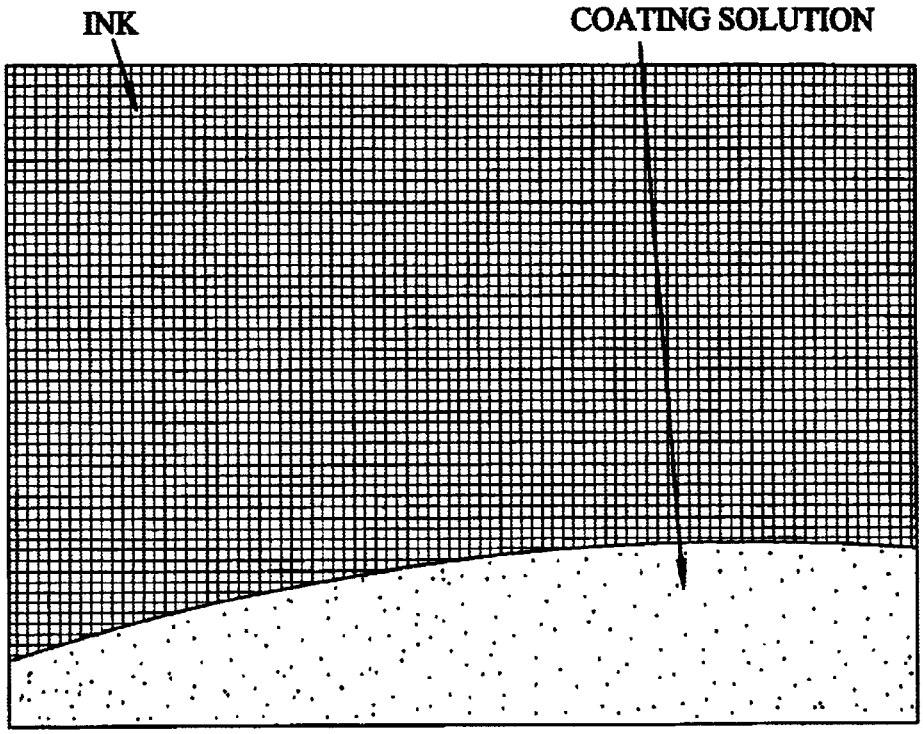
FIGS. 4A through 4F are a series of time lapse photographs showing the interaction of an ink and a coating solution according to one embodiment of the present invention.
Figure 4B:
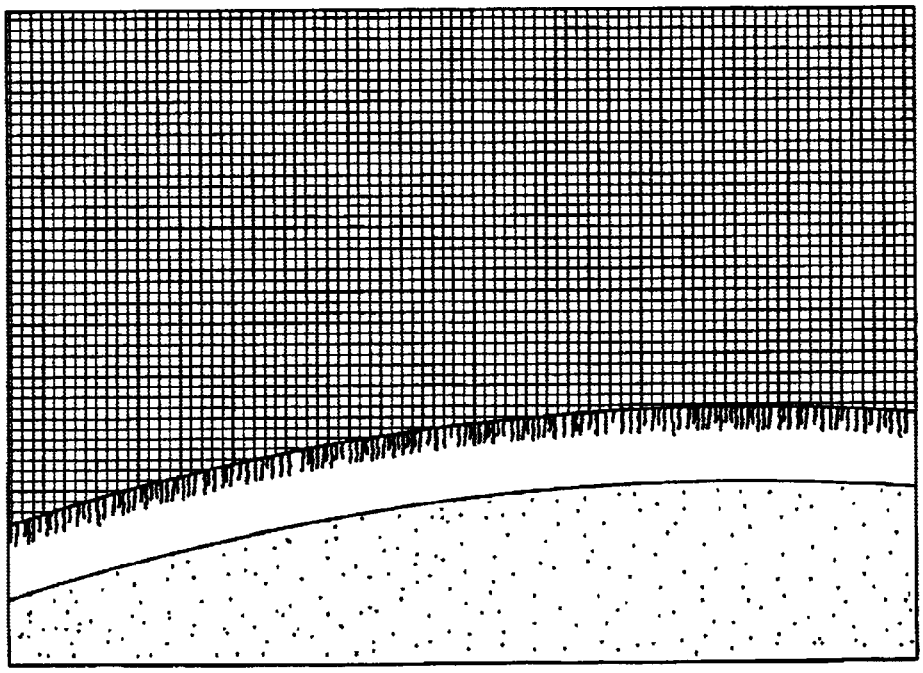
Figure 4C:
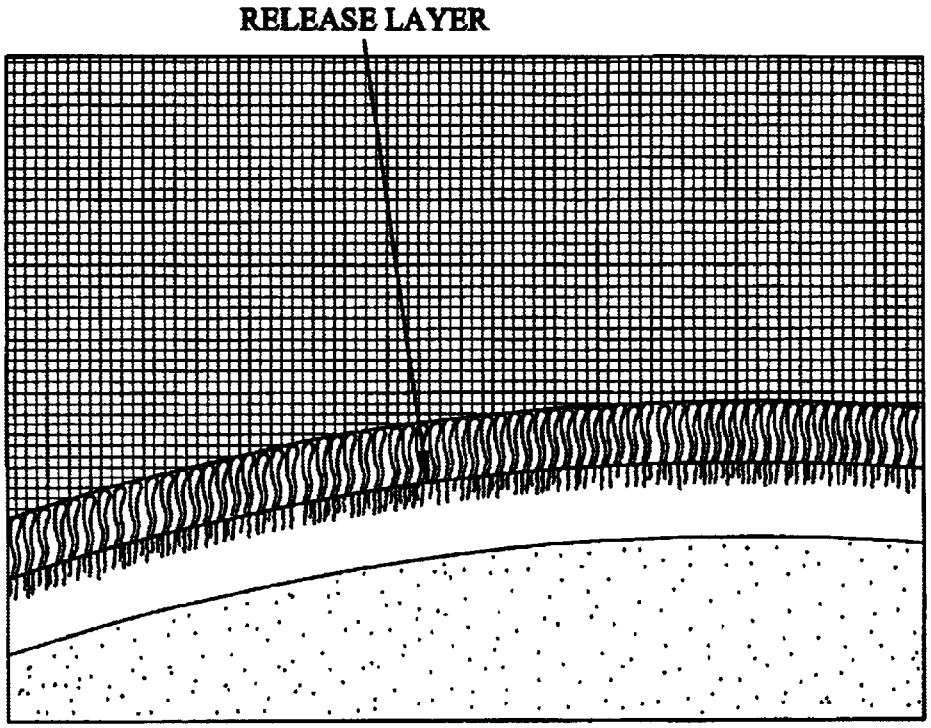
Figure 4D:
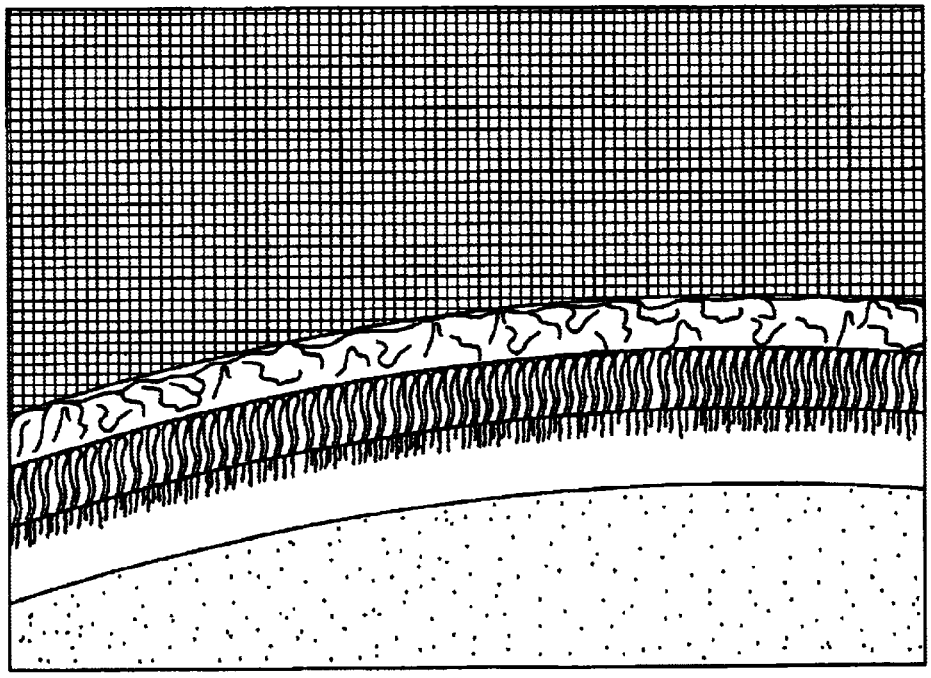
Figure 4E:
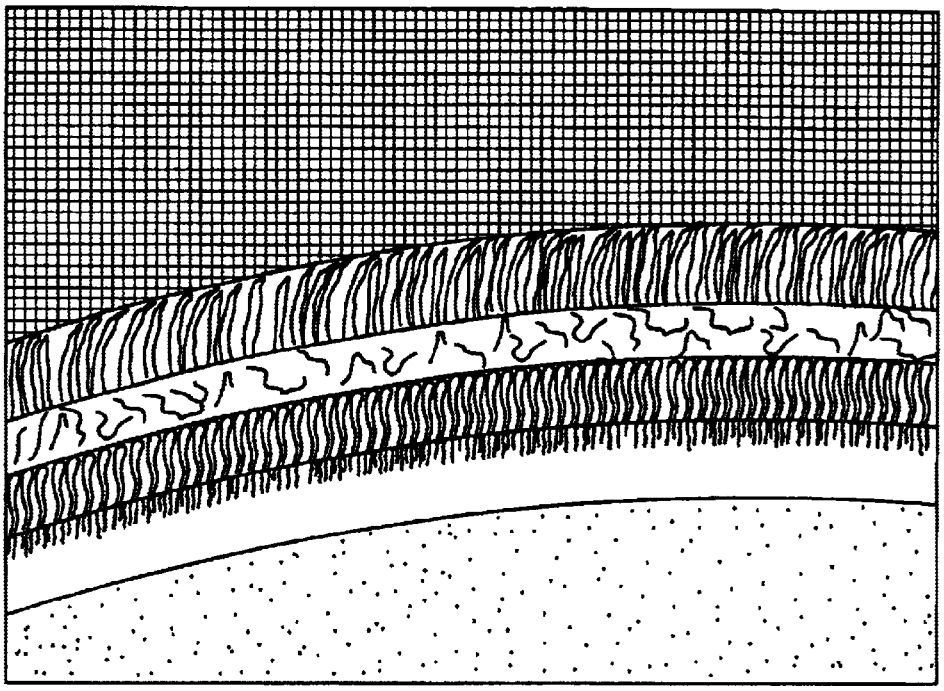
Figure 4F:
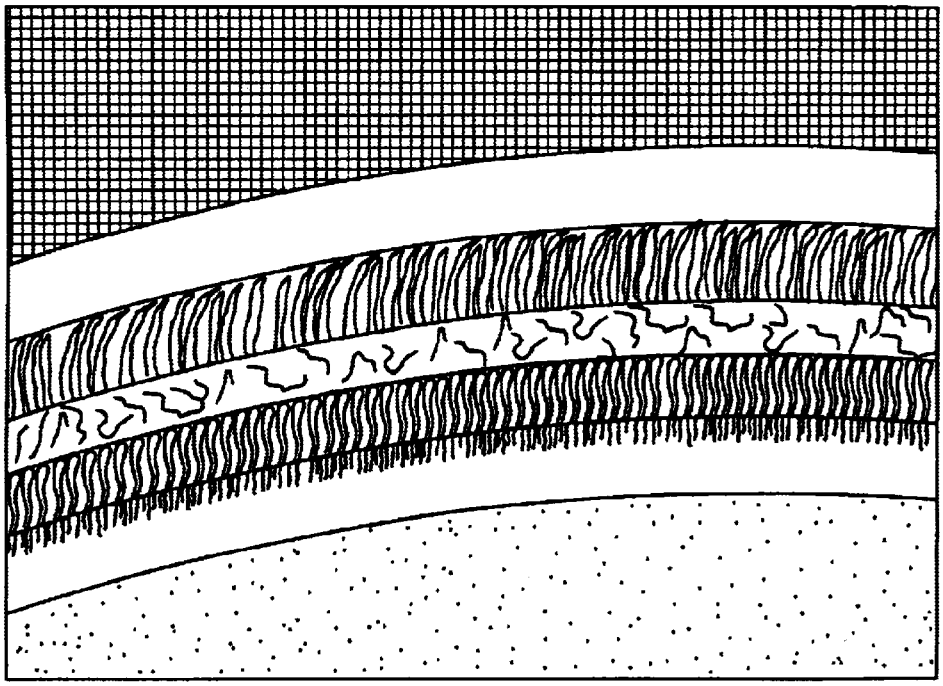

To analyze the film split, experiments were conducted to calculate the weight of the coating solution on the paper and on the intermediate transfer medium, after transfer. This was accomplished by coating the intermediate transfer medium only with coating solution and transferring the coating solution to successive sheets of paper. For there to be a 50/50 film split, the measured weight of coating solution on each page theoretically should decrease by 50% with each successive page. This is what occurred, as demonstrated by the film split efficiency chart shown in FIG. 3.

The experimental diameter of an ink drop has been found to be approximately 25 $\mu$m. Taking the drop diameter into consideration and knowing that the coating solution wets the ink, the height of the ink on the intermediate transfer medium should be about 12–15 $\mu$m. The coating solution is coated on the intermediate transfer medium to a thickness of 1–10 μm. The ink/coating solution volumetric ratio can therefore range from 1/1 to 15/1. If the same 50/50 film split ratio were taking place, one would expect to see an incomplete transfer of the image and high residual ink levels on the intermediate transfer medium. In fact, greater than 50% of the colorant forming the image was transferred to the paper in a plurality of test runs, thus demonstrating the efficiency of the release layer.

Example Eight

In another experiment, the interaction of the ink and the coating solution was filmed in real time. A test was developed that restricts the motion of the ink in two dimensions to clearly and accurately document the interaction. In this test, a drop of coating solution was placed on a glass slide substrate. A thin glass cover slide ("the first slide") was placed on this drop such that a thin film of the coating solution spread evenly under the first slide with a little excess coating solution extending out from an edge of the first slide. A small drop of ink was placed on the substrate. The small drop of ink was placed a few mm from the portion of the coating solution, which extended out of the first slide. A second thin glass cover slide ("second slide") was then placed over the substrate to cover the drop of ink. The edge of the second slide also overlapped some of the excess coating extending out of the first slide. The second slide was lowered toward the substrate such that the first and second slides had adjacent edges. Filming began when the ink came into contact with the coating solution. At this point in time, a thin release layer was formed on the substrate between the ink and the coating solution.

FIGS. 4A through 4F are a series of time lapse photos showing the interaction of the ink with the coating solution. These photos were taken above the first and second slides. It should be noted that for FIGS. 4D through 4F, a longer time elapsed. During an actual printing process, the image or a portion thereof, may be transferred to the final media from the intermediate transfer medium before the conditions shown in FIGS. 4D through 4F would occur. As can be seen, the layers form as described previously. Components in the coating solution and components in the ink diffuse toward one another to destabilize at least the lower portion of the ink. A thin release layer separates the ink from a viscous coating remaining from the coating solution.

While the invention has been described in connection with the preferred embodiments, it will be understood that modifications within the principles outlined above will be evident to those skilled in the art.

What is claimed is:

1. A method of printing, comprising:

depositing a release coat on an intermediate transfer medium;

depositing an ink on the release coat, the ink containing a colorant;

allowing material in the release coat to diffuse into the ink;

causing the colorant in the ink to retreat from the intermediate transfer medium and the material diffusing from the release coat; and transferring the ink to a final transfer medium.

2. A method of printing according to claim 1, further comprising destabilizing the ink with the material diffusing from the release coat.

3. A method of printing according to claim 1, further comprising allowing material in the ink to diffuse into the release coat.

4. A method of printing according to claim 1, wherein the material in the release coat is a material containing salt protons or acid protons.

5. A method of printing according to claim 1, wherein the material in the release coat comprises:

at least one solvent selected from the group consisting of glycol solvents and diol solvents; and a carboxylic acid or a salt, the carboxylic acid being selected from the group consisting of citric acid, glycolic acid, tartaric acid, 1,2,3,4-butane tetracarboxylic acid, glutaric acid, succinic acid, lactic acid, and adipic acid, the salt being selected from the group consisting of $CaCl_2$, $AlCl_3$, and magnesium salicylate tetrahydrate.

* * * * *